US009194109B2

(12) United States Patent
Ho

(10) Patent No.: US 9,194,109 B2
(45) Date of Patent: Nov. 24, 2015

(54) MODULAR FAUCET

(71) Applicant: Chyi Liou Enterprises Co., Ltd., Changhua (TW)

(72) Inventor: Chin-Hua Ho, Changhua (TW)

(73) Assignee: Chyi Liou Enterprises Co., Ltd., Changhua (TW)

( * ) Notice: Subject to any disclaimer, the term of this patent is extended or adjusted under 35 U.S.C. 154(b) by 63 days.

(21) Appl. No.: 14/231,766

(22) Filed: Apr. 1, 2014

(65) Prior Publication Data

US 2014/0209187 A1 Jul. 31, 2014

(51) Int. Cl.
*E03C 1/04* (2006.01)

(52) U.S. Cl.
CPC ..... *E03C 1/04* (2013.01); *E03C 1/0404* (2013.01); *E03C 2001/0415* (2013.01); *Y10T 137/598* (2015.04)

(58) Field of Classification Search
CPC ..... E03C 2001/0415; F16L 33/28; F16L 37/0985; F16L 37/0987; F16L 37/248
USPC ..... 137/355.16
See application file for complete search history.

(56) References Cited

U.S. PATENT DOCUMENTS

2002/0170608 A1* 11/2002 Marty et al. ..... 137/801
2007/0045449 A1* 3/2007 Herring et al. ..... 239/525
2008/0093846 A1* 4/2008 Sparks et al. ..... 285/330

* cited by examiner

*Primary Examiner* — Craig Schneider
*Assistant Examiner* — Patrick C Williams

(57) ABSTRACT

A modular faucet is provided with a pipe including an inner well, an aperture proximate to a first end, a groove at a second end, and a recess communicating with the groove; a tee including an externally threaded hollow cylinder, a projection on an inner surface of the cylinder, and a depression on an outer surface and communicating with the cylinder wherein the recess passes through the projection and is fastened in the groove; a hose having one end threadedly secured to the longitudinal part and an internally threaded other end; a spout including a latch at one end, and an externally threaded projection at one end; and a hollow adapter including a slot on an inner surface, a protuberance on an outer surface, and a protrusion distal the protuberance. The hose passes through the depression, the cylinder, and the pipe to threadedly secure to the spout.

1 Claim, 8 Drawing Sheets

MODULAR FAUCET

BACKGROUND OF THE INVENTION

1. Field of the Invention

The invention relates to faucets and more particularly to a modular faucet with improved characteristics including an extendable spout.

2. Description of Related Art

A conventional faucet is shown in FIGS. 1, 2A, 2B and 3. The faucet includes a sink deck A, cold and hot water valves A1 on both sides of the sink deck A, a pipe A2 extending upward from the sink deck A, two couplings F each threadedly secured to one of the cold and hot water valves A1, a tee B mounted on an underside of the sink deck A and including two lateral parts communicating with the couplings F respectively, and a longitudinal part B2 secured to one end of a flexible hose C by means of a nut C1, and two weights E mounted on the hose C under the sink deck A. The hose C passes through an opening B1 of the tee B into the tee B. Further, the hose C passes through the pipe A2 to connect to a spout D by threadedly securing a nut C2 at its end to a threaded projection D1 at a rear end of the spout D.

In use, a person may pull the hose C a short distance. Further, the weights E facilitate the hose C pulling back to its concealed position after use. However, the spout D may turn undesirably due to no fastening means for fixing the spout D (see FIGS. 2A and 2B). Moreover, the hose C may be jammed due to tight engagement of the opening B1 and a portion of the hose C (see FIG. 3). In addition, the opening B1 may be broken after a number of pulling and retracting operations.

Thus, the need for improvement still exists.

SUMMARY OF THE INVENTION

It is therefore one object of the invention to provide a modular faucet comprising a pipe including a first end, a well on an inner surface of the first end, an aperture proximate to the first end, a groove at a second end, and a recess adjacent to the groove and communicating with the groove; a tee including an externally threaded hollow cylinder, a projection on an inner surface of the externally threaded hollow cylinder, two lateral parts, a longitudinal part, and a depression on an outer surface of a joining portion of the lateral parts and communicating with the externally threaded hollow cylinder wherein the recess is configured to pass through the projection and fastened in the groove; a flexible hose having one end threadedly secured to the longitudinal part and an internally threaded other end; a spout including an inverted L-shaped latch at one end, and an externally threaded projection at one end; a hollow adapter including an L-shaped slot on an inner surface, a protuberance on an outer surface, and a protrusion distal the protuberance; and a union put on the pipe and threadedly secured to the externally threaded hollow cylinder; wherein the hose passes through the depression, the externally threaded hollow cylinder, and the pipe to threadedly secure the internally threaded other end thereof to the externally threaded projection of the spout; and wherein the protrusion is releasably fastened in the aperture, the protuberance is releasably fastened in the well, and the inverted L-shaped latch is releasably fastened in the L-shaped slot.

The above and other objects, features and advantages of the invention will become apparent from the following detailed description taken with the accompanying drawings.

DETAILED DESCRIPTION OF THE INVENTION

Figure 1:
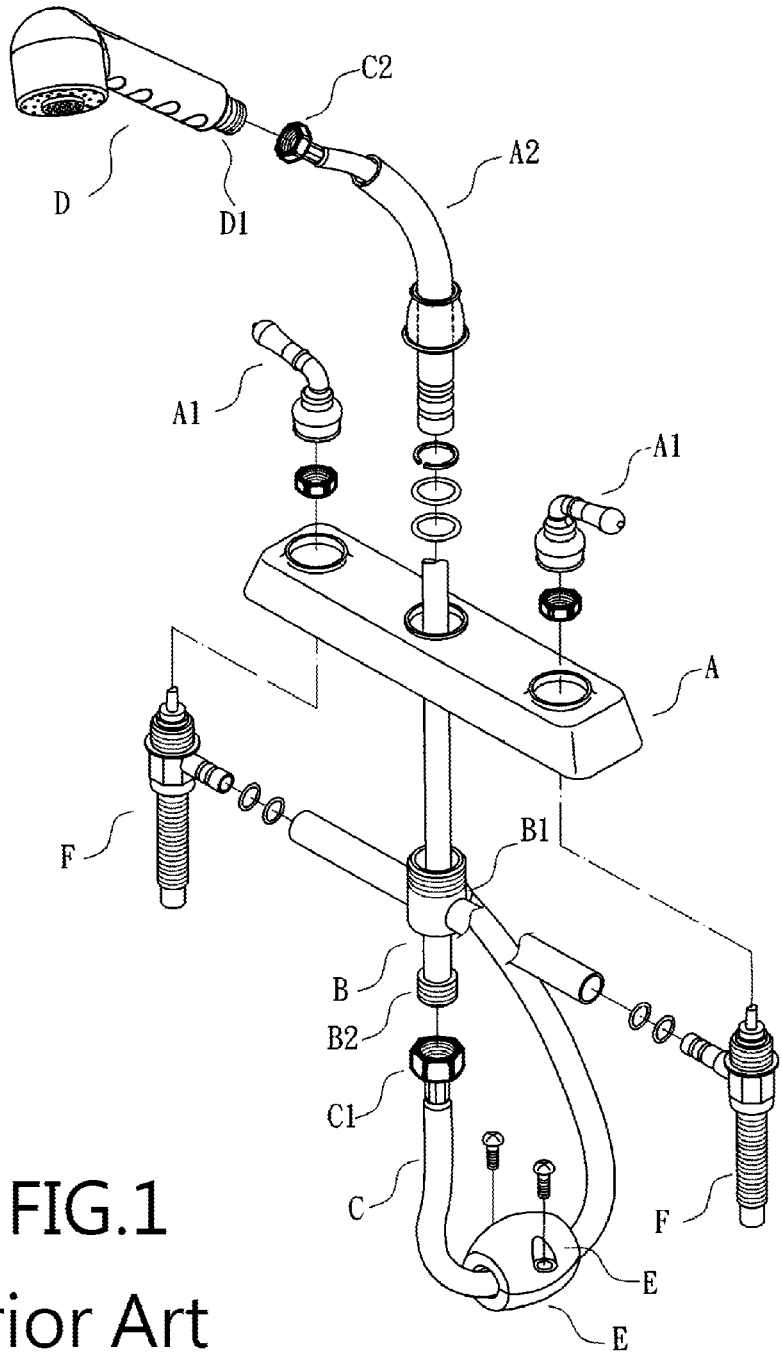
FIG.1 Prior Art
FIG. 1 is an exploded view of a conventional faucet.
Figure 3:
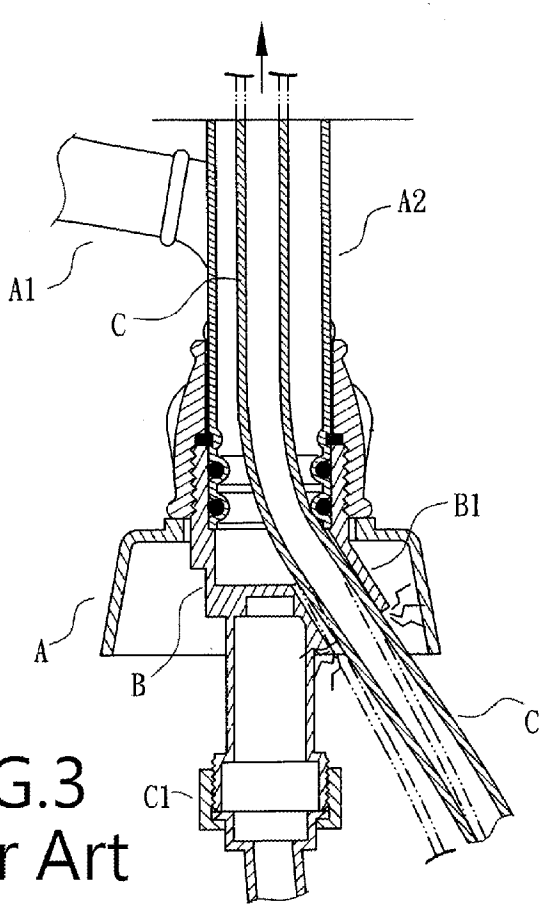
FIG.3 Prior Art
FIG. 3 is a longitudinal sectional view of the tee and adjacent components.
Figure 2B:
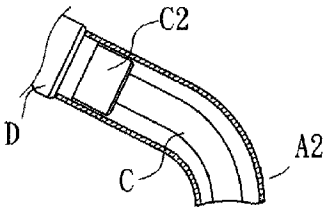
FIG.2B Prior Art
FIG. 2B is a broken away view of a section of the pipe near the spout.
Figure 2A:
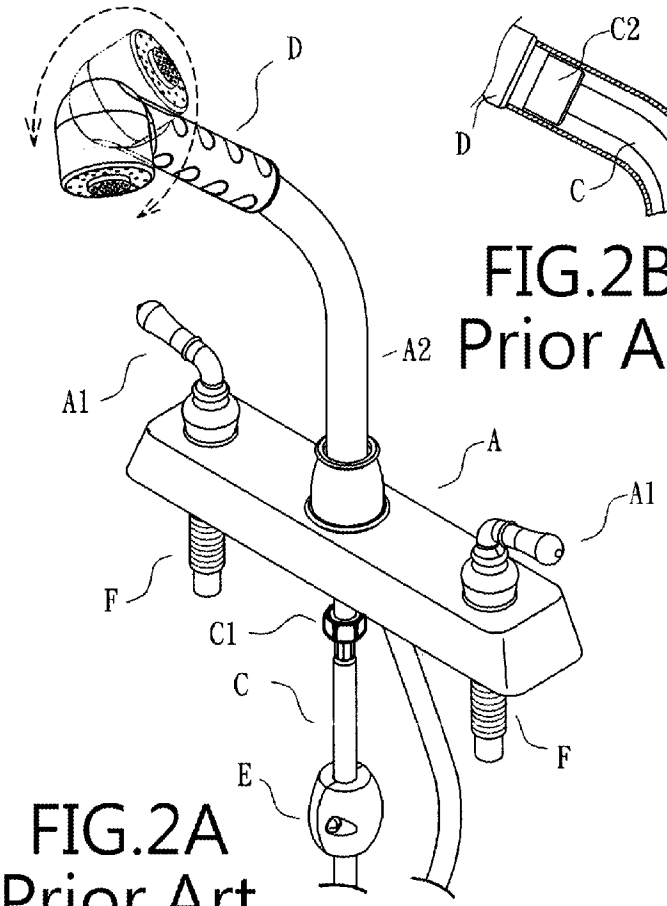
FIG.2A Prior Art
FIG. 2A is a perspective view of the assembled faucet.
Figures 4A, 4B:
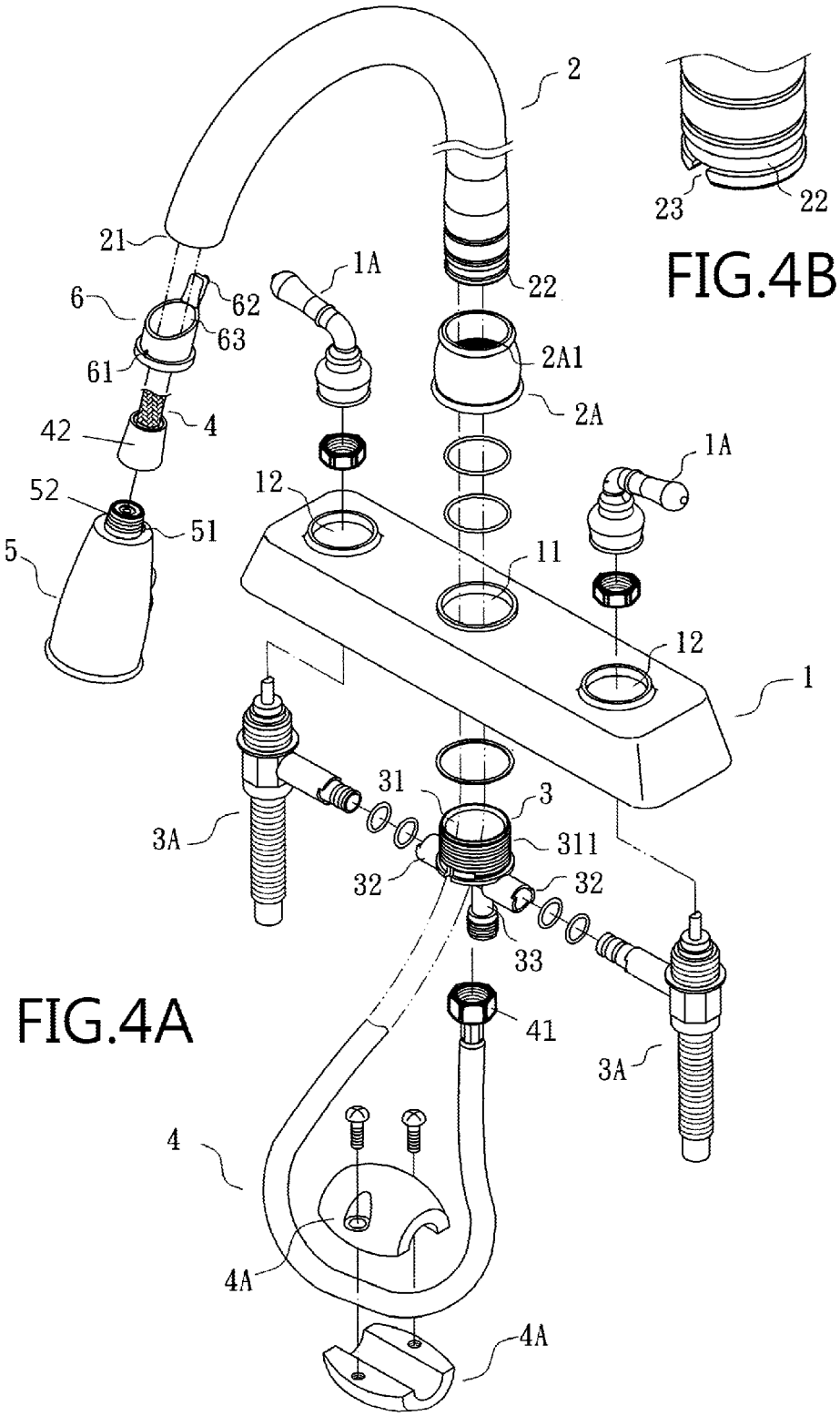
FIG. 4A is an exploded view of a faucet according to the invention.
FIG. 4B is an enlarged view of the groove and the recess shown in FIG. 4A.
Figure 5A:
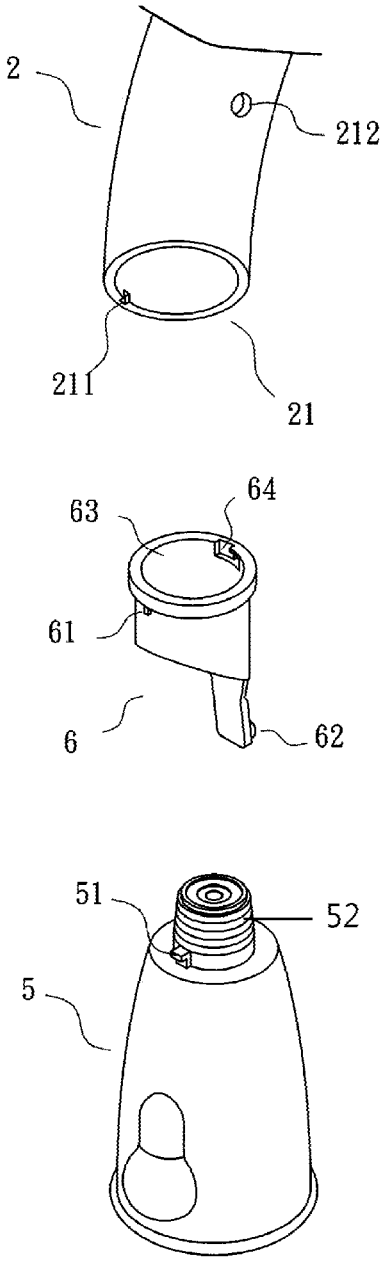
FIG. 5A is an exploded view of the spout and portions of adjacent components.
Figure 5B:
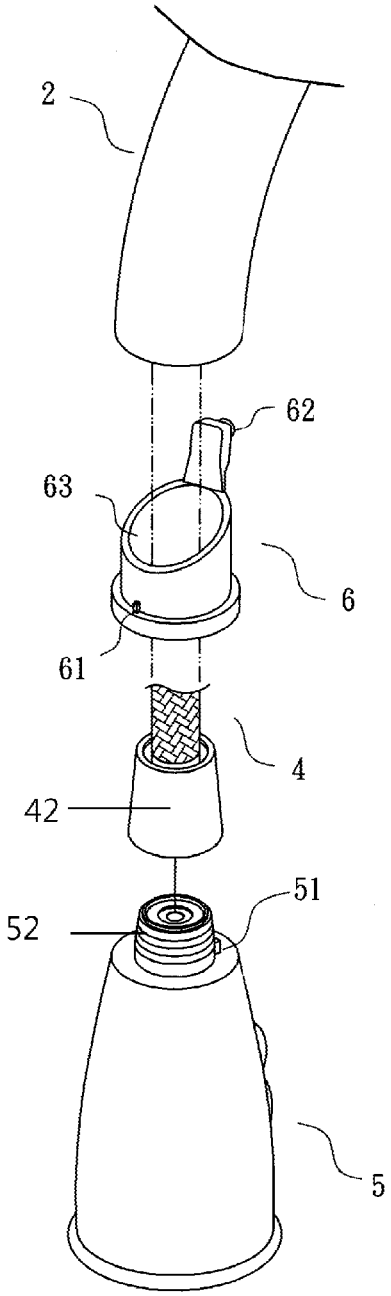
FIG. 5B is another exploded view of the spout and portions of adjacent components.
Figure 6:
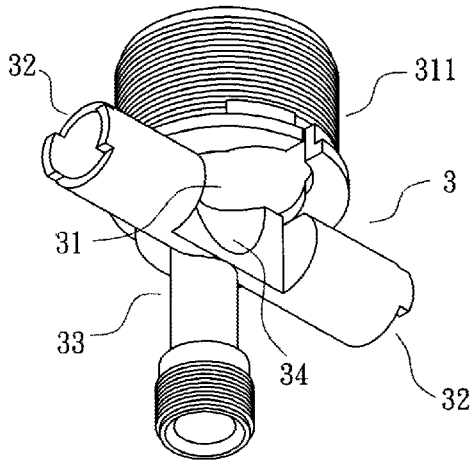
FIG. 6 is a perspective view of the tee.
Figure 7:
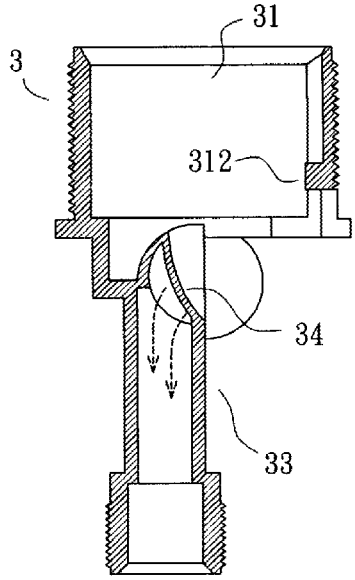
FIG. 7 is a longitudinal sectional view of the tee.
Figure 8:
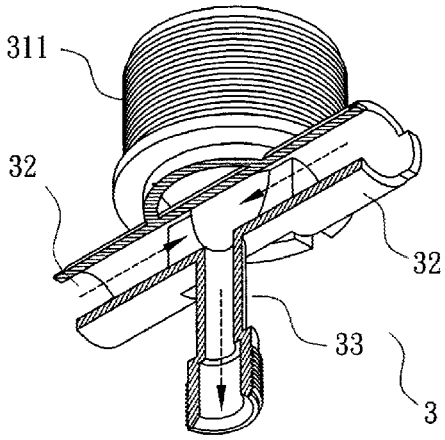
FIG. 8 is a broken away view of the tee.
Figure 9:
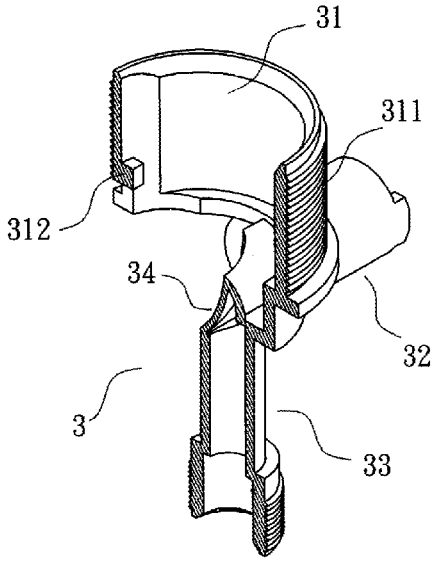
FIG. 9 is another broken away view of the tee.

Referring to FIGS. 4A to 15, a faucet in accordance with the invention comprises the following components as discussed in detail below.

A sink deck 1 having a central opening 11 and two side openings 12, cold and hot water valves 1A on both sides of the sink deck 1, a pipe 2 having a first end 21, a well 211 on the mouth of the first end 21, and an aperture 212 proximate to the first end 21, an annular groove 22 at a second end, and a recess 23 below the groove 22 and communicating with the groove 22, and two couplings 3A each threadedly secured to one of the cold and hot water valves 1A are provided. Each of the cold and hot water valves 1A is threadedly secured to one of the couplings 3A at either side opening 12.

A tee 3 is mounted on an underside of the sink deck 1 and including an upper, hollow cylinder 31 having threads 311 on an outer surface and a projection 312 on an inner surface near bottom, two lateral parts 32 connected to and communicating with the couplings 3A respectively, a longitudinal part 33, and a depression 34 on an outer surface of a joining portion of the lateral parts 32 between the hollow cylinder 31 and the longitudinal part 33, the depression 34 communicating with the hollow cylinder 31.

A flexible hose 4 has one end 41 threadedly secured to the longitudinal part 33. The hose 4 passes the hollow cylinder 31 by complimentarily engaging the depression 34. The hose 4 further passes the pipe 2 and extends out of the first end 21. A spout 5 has an inverted L-shaped latch 51 at one end, and an externally threaded projection 52 at one end.

Two weights 4A are mounted on the hose 4 under the sink deck 1. In assembly (see FIGS. 11A, 11B, 12, and 13), a person may put a union 2A on a straight part of the pipe 2. Next, the person may press down the pipe 2 until the recess 23 passes through the projection 312 and stopped by the edge of the groove 22. Next, the person may clockwise turn the pipe 2 until the projection 312 is fastened by a narrow portion of the groove 22. Finally, the person may push down the union 2A to threadedly secure internal threads 2A1 of the union 2A to the threads 311. As an end, the pipe 2 is mounted on top of the sink deck 1 by securing to the tee 3.

A cylindrical adapter 6 includes a protuberance 61 on an outer surface, a protrusion 62 distal the protuberance 61, an axial channel 63, and an L-shaped slot 64 on an inner surface of the channel 63 distal the protrusion 62 and opposite to the protuberance 61. In assembly (see FIGS. 5A and 5B), the other end 42 of the hose 4 passes the first end 21 and the channel 63 to threadedly secured to the externally threaded projection 52. Further, the protrusion 62 is fastened in the aperture 212 by snapping, the protuberance 62 is fastened in the well 211 by snapping, and the latch 51 is fastened in the slot 64 by snapping.

Figure 10:
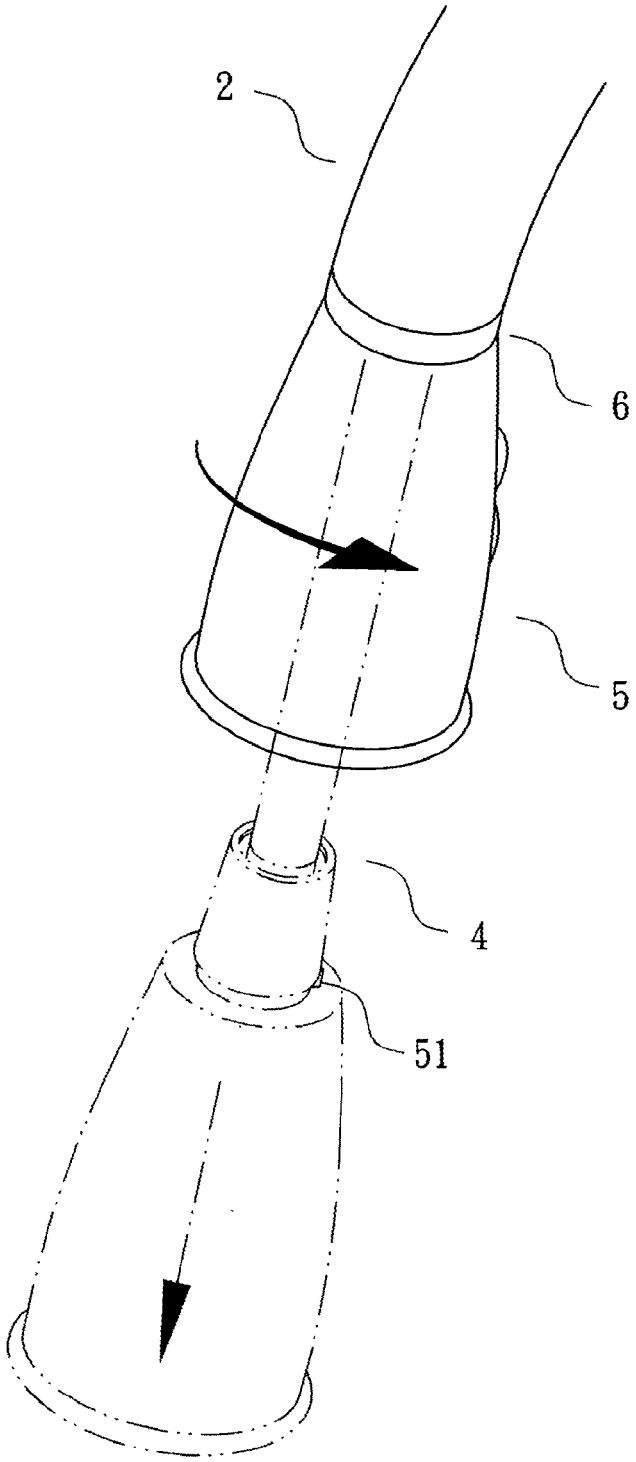
FIG. 10 is a perspective view showing the spout being pulled out a short distance from its anchored position.
Figures 11A, 11B, 12, 13:
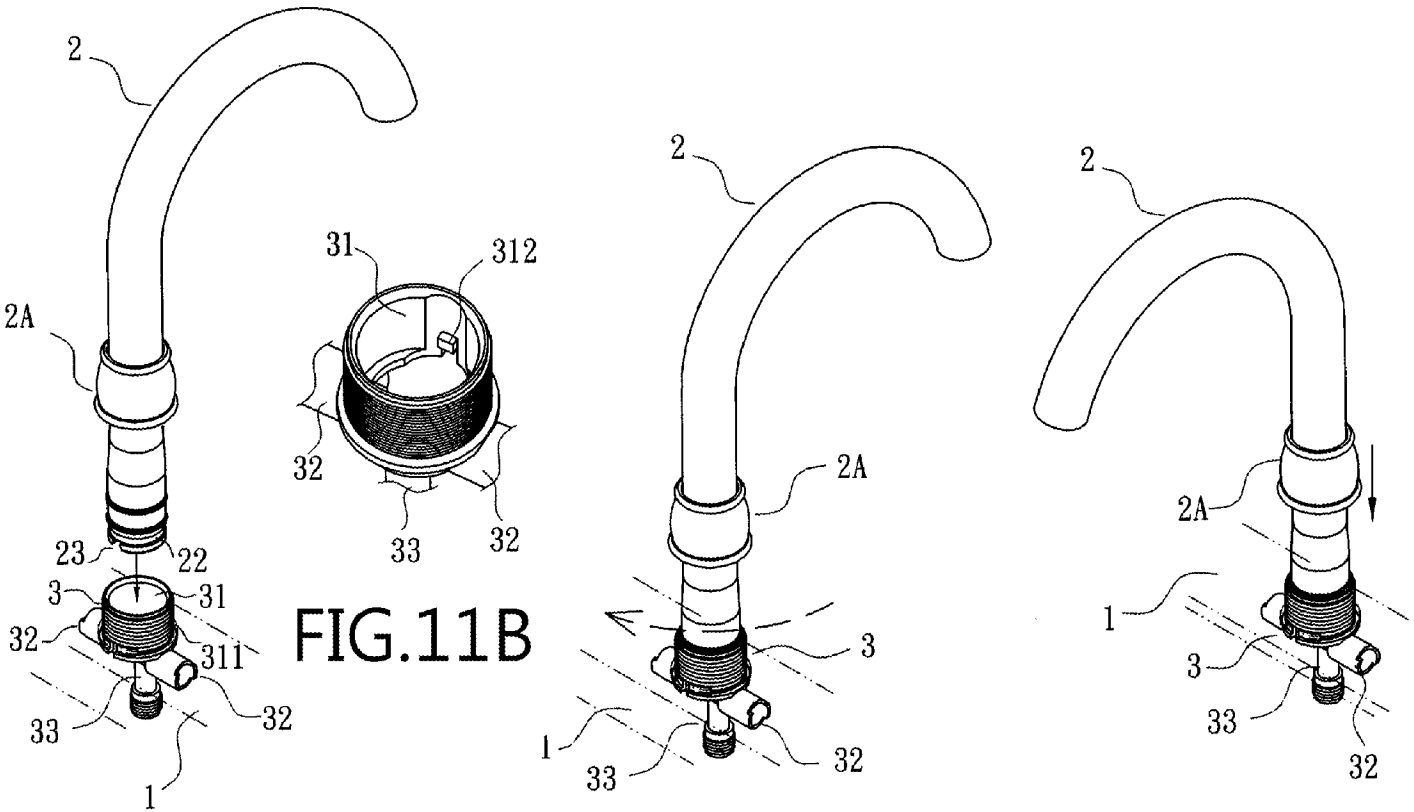
FIG. 11A is an exploded view of the spout, the tee, and associated components.
FIG. 11B is a perspective view of the tee shown in FIG. 11A.
FIG. 12 is a perspective view of the assembled spout, the tee, and associated components.
FIG. 13 is a view similar to FIG. 12.
Figure 15:
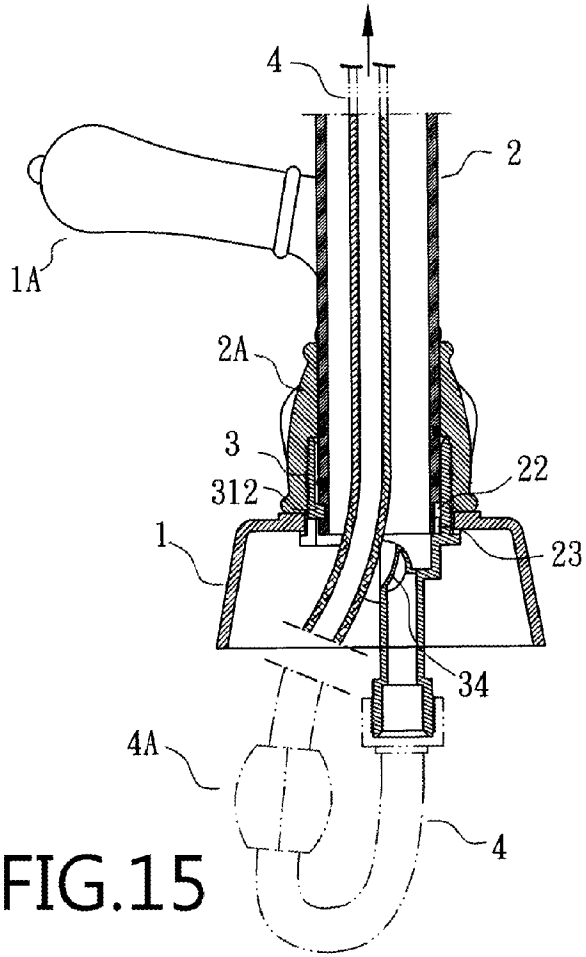
FIG. 15 is a longitudinal sectional view of the tee and adjacent components shown in FIG. 14.
Figure 14:
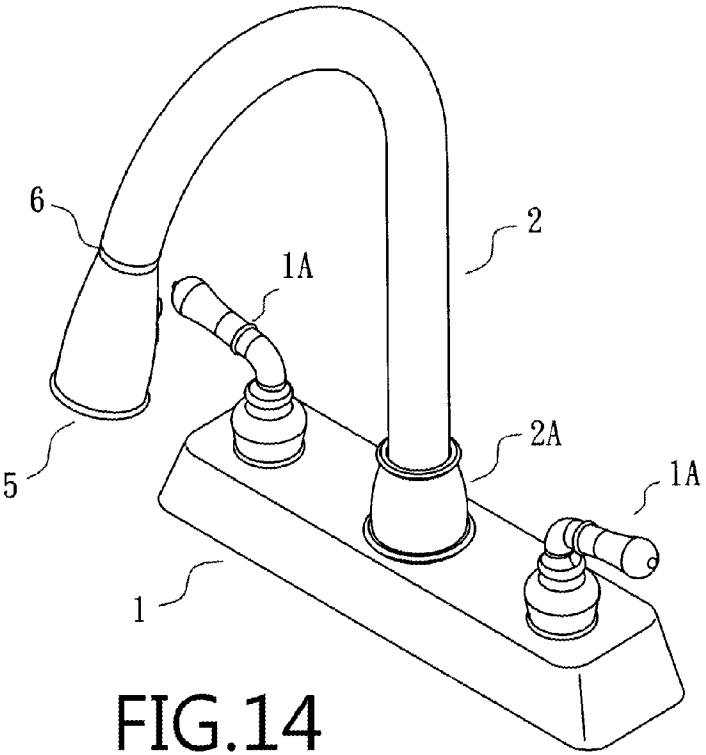
FIG. 14 is a perspective view of the faucet mounted on a sink deck.

In use, a person may turn on, for example, the hot water valve 1A to flow hot water to the spout 5 via the coupling 3A, the lateral part 32, the longitudinal part 33, and the hose 4. Further, as shown in FIG. 10, the person may counterclockwise turn the spout 5 to disengage the latch 51 from the slot 64. Thus, the spout 5 is not fastened by the adapter 6. Finally, the person may pull the spout 5 a desired distance out of the pipe 2 for washing hands or other purposes.

While the invention has been described in terms of preferred embodiments, those skilled in the art will recognize that the invention can be practiced with modifications within the spirit and scope of the appended claims.

What is claimed is:

1. A modular faucet comprising:

a pipe including a first end, a well on an inner surface of the first end, an aperture proximate to the first end, a groove at a second end, and a recess adjacent to the groove and communicating with the groove;

a tee including an externally threaded hollow cylinder, a projection on an inner surface of the externally threaded hollow cylinder, two lateral parts, a longitudinal part, and a depression on an outer surface of a joining portion of the lateral parts and communicating with the externally threaded hollow cylinder wherein the recess is configured to pass through the projection and is fastened in the groove;

a flexible hose having one end threadedly secured to the longitudinal part and an internally threaded other end;

a spout including an inverted L-shaped latch at one end, and an externally threaded projection at one end;

a hollow adapter including an L-shaped slot on an inner surface, a protuberance on an outer surface, and a protrusion distal the protuberance; and a union put on the pipe and threadedly secured to the externally threaded hollow cylinder;

wherein the flexible hose passes through the depression, the externally threaded hollow cylinder, and the pipe to threadedly secure the internally threaded other end thereof to the externally threaded projection of the spout; and wherein the protrusion is releasably fastened in the aperture, the protuberance is releasably fastened in the well, and the inverted L-shaped latch is releasably fastened in the L-shaped slot.

* * * * *